United States Patent [19]

Hanaoka et al.

[11] Patent Number: 4,646,803

[45] Date of Patent: Mar. 3, 1987

[54] CASE FOR PROTECTING A MAGNETIC CORE

[75] Inventors: Katsumi Hanaoka, Kawanishi; Yasuo Yamamoto, Settsu; Kazuhiro Arii, Kobe; Kazuhiro Tanaka, Suita, all of Japan

[73] Assignee: Allied Corporation, New York, N.Y.

[21] Appl. No.: 749,304

[22] Filed: Jun. 27, 1985

[30] Foreign Application Priority Data

Jun. 28, 1984 [JP] Japan ..... 59-96041[U]

[51] Int. Cl.[4] ..... B65D 85/02; B65D 85/69; H01F 27/02; H01F 27/30

[52] U.S. Cl. ..... 150/52 R; 150/54 B; 206/303; 206/328; 206/398; 206/408; 336/90; 336/198

[58] Field of Search ..... 150/52 R, 54; 206/304, 206/328, 494, 398, 414, 416, 303, 408; 336/82, 90, 198; 335/250, 282, 299

[56] References Cited

U.S. PATENT DOCUMENTS

| | | | |
|---|---|---|---|
| 2,962,803 | 12/1960 | Jones | 336/90 X |
| 2,988,674 | 6/1961 | Pizza | 336/198 X |
| 3,042,841 | 7/1962 | Bryan | 336/90 X |
| 3,060,353 | 10/1962 | Shansky et al. | 336/90 X |
| 3,070,766 | 12/1962 | Purdy | 336/198 X |
| 3,199,177 | 8/1965 | Brandon, Jr. et al. | 336/90 X |
| 3,243,746 | 3/1966 | Doggart et al. | 336/198 X |
| 4,221,293 | 9/1980 | Anthony | 206/494 |

FOREIGN PATENT DOCUMENTS

| | | | |
|---|---|---|---|
| 51527 | 4/1977 | Japan | 336/90 |
| 9325 | of 1902 | United Kingdom | 336/198 |

*Primary Examiner*—William Price
*Assistant Examiner*—Sue A. Weaver
*Attorney, Agent, or Firm*—Scully, Scott, Murphy & Presser

[57] ABSTRACT

In the present invention, there is disclosed a case for protecting a magnetic core having a substantially enclosed shape being constructed in combination with a case body comprising an inner and outer members which are adapted to cover the inner and outer peripheral surfaces of the magnetic core respectively, a bottom member being adapted to cover the bottom surface of the magnetic core which has a substantially "U" shaped cross section and a cap member being adapted to cover the top surface of the magnetic core which has a substantially reversed "U" shaped cross section, which is characterized in that a taper surface is formed on each of the surfaces of the inner and outer members opposing to the inner and outer surfaces of the magnetic core respectively, said taper surface being so inclined as to contact to the opposed surface of the magnetic core at the middle portion thereof when seen in the axial direction of the core.

3 Claims, 5 Drawing Figures

CASE FOR PROTECTING A MAGNETIC CORE

BACKGROUND OF THE INVENTION

1. Field of the Invention

The present invention relates to a protecting case for covering the outer surface of a magnetic core.

2. Description of the Prior Art

In JP-A No. 115805/1983, there has been proposed a transformer, as is shown in FIG. 1, having a troidal magnetic core 1 being formed of coiled strip material such as a magnetic permeable amorphous metal. The troidal magnetic core made of an amorphous metal becomes very fragile after the quenching thereof, which is necessary to obtain good magnetic properties. If such a fragile magnetic core is submerged in the oil of the transformer as itself, the core is easily chipped, for instance on the edges thereof, due to stresses caused by an external force or due to vibrations of the transformer. If such fragments having been chipped are floated in the oil of the transformer, the properties of the transformer may be lowered or an accident thereof may be caused. In order to avoid such disadvantages, it is necessary to cover the surface of such a troidal core with a cover which is able to prevent floating of chipped fragments.

Conventionally, as is shown in FIG. 2, there is used a core case 2 for protecting a troidal core 1 being comprised of an inner and outer cylindrical members 3A and 3B for covering the inner and outer peripheries of the troidal core 1 respectively, a bottom ring member 4 for covering the lower surface of the core which has an inner and outer upward ribs respectively formed along the inner and outer peripheries thereof, and a cap ring member 5 for covering the upper surface of the core which has an inner and outer downward ribs respectively formed along the inner and outer peripheries thereof. It is necessary to form each of members 3 to 5 of an insulating material such as a synthetic resin so as to have relatively large thickness thereof for containing a heavy magnetic core therein. Further, the inner and outer cylindrical members 3A and 3B are respectively formed to have a gap 6 respectively between the inner periphery of the troidal core and the inner cylindrical member 3A and between the outer periphery of the troidal core and the outer cylindrical member 3B in order to ensure smooth fitting between the troidal core and the inner or outer cylindrical member. After constructing the core case 2 so as to enclose the troidal core therein, a winding 7 is wound around the trunk of the core case and the core case 2 is tightly bound by the winding 7.

However, since the inner and outer cylindrical members 3A and 3B are so formed to have a gap between the magnetic core, there is a possibility that the predetermined magnetic properties of the magnetic core can not be obtained due to deformations of the magnetic core which may be caused by movements thereof upon the construction of the core and/or the winding of the winding 7.

Further, since there are formed two cylindrical space 8 between the core case 2 and the winding 7 wound therearound, the contacting density of the winding 7 to the magnetic core 1 becomes lowered and, due to this, the transformer becomes bulky and uneconomical with the increased length of the conducting wire for forming the winding.

In order to avoid such disadvantages as mentioned above, as is shown in FIG. 2, there considered a method using a tape 9 for wrapping the entire surface of the magnetic core 1 by winding the tape around the core troidally.

However, this method has a disadvantage in that the magnetic energy loss is increased due to possible distortions of the magnetic core which may be caused by stresses exerted thereto upon winding the tape. Moreover, since the taping method is time-consuming and many manufacturing steps are needed, it is improper to the mass production. Regarding to the mentioned above, there considered also a method by insert-molding the magnetic core with a synthetic resin. This method, however, has a disadvantage in that the magnetic energy loss is increased due to distortions of the magnetic core which may be caused by thermal stresses exerted thereto upon the solidification of the resin.

SUMMARY OF THE INVENTION

An essential object of the present invention is to provide a protecting case for a magnetic core being able to reduce spaces between the magnetic core and the winding thereof almost equal to zero and able to wrap the magnetic core entirely without exerting any stress to the magnetic core therein.

According to the present invention, there is provided a case for protecting a magnetic core having a substantially enclosed shape being constructed in combination with a case body comprising an inner and outer members which are adapted to cover the inner and outer peripheral surfaces of the magnetic core respectively, a bottom member being adapted to cover the bottom surface of the magnetic core which has a substantially "U" shaped cross section and a cap member being adapted to cover the top surface of the magnetic core which has a substantially reversed "U" shaped cross section, which is characterized in that a taper surface is formed on each of the surfaces of the inner and outer members opposing to the inner and outer surfaces of the magnetic core respectively, said taper surface being so inclined as to contact to the opposed surface of the magnetic core at the middle portion thereof when seen in the axial direction of the core, that a fitting surface is formed circumferentially on each of upper and lower end portions of the inner and the outer members, said fitting surface being adapted to fit to a taper surface in the axial direction which is formed on each peripheral side surface of each of the rib portions of the bottom and cap members, and that the external surface of every fitting portion defined between each of the fitting surfaces of the inner and outer members and each of the rib portions of the bottom and cap members has such a smooth surface as to be in a plane defined by each external surface of the inner and outer members.

According to the present invention, since the inner and outer peripheral members have taper surfaces on the sides opposing to the magnetic core respectively, operations for mounting the inner and outer peripheral members against the magnetic core can be done easily utilizing said taper surfaces. Further, since each fitting portion between the case body and the bottom or cap member has a flat and smooth surface, there is formed no space or gap between the outer surface of the case and the winding to be wound around the trunk of the case.

Moreover, since the fitting between the case body and the bottom member or the cap member can be done with the aid of taper surfaces, the fitting operation is simplified.

BRIEF DESCRIPTION OF THE DRAWINGS

The present invention will be more fully understood and further advantages will become apparent when reference is made to the following detailed description of the accompanying drawings in which.

DESCRIPTION OF THE PREFERRED EMBODIMENT

Figure 1:
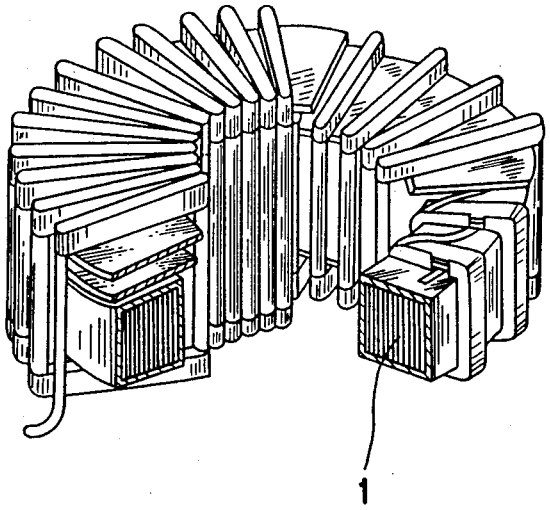
PRIOR ART Fig. 1
FIG. 1 is a perspective view partially broken away, showing a transformer having a troidal core.
Figure 2:
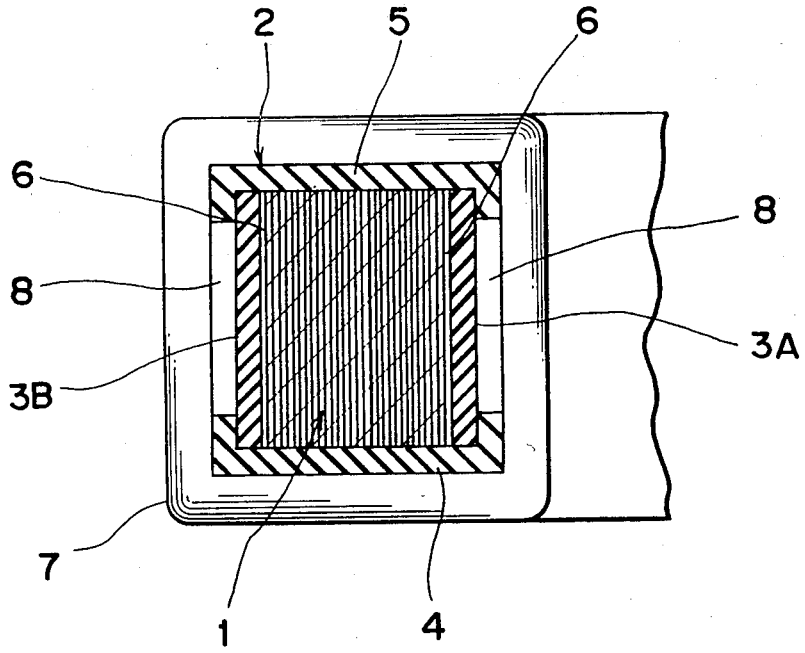
PRIOR ART Fig. 2
FIG. 2 is a cross sectional view of a conventional protecting case for a troidal core.
Figure 3:
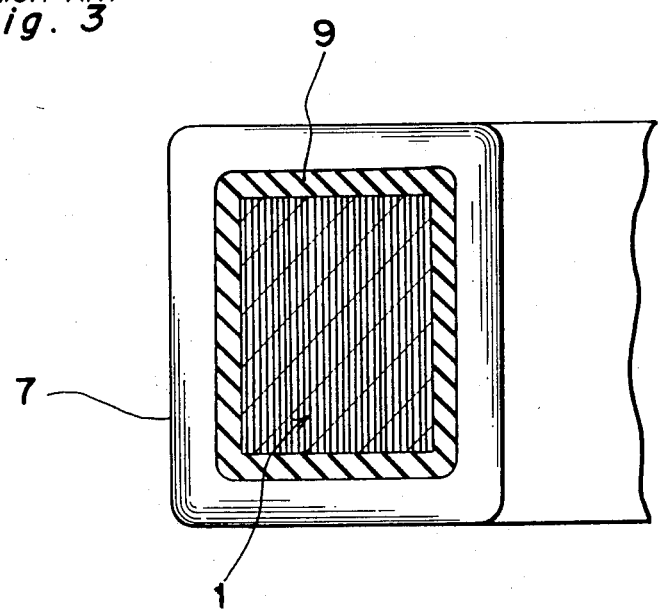
PRIOR ART Fig. 3
FIG. 3 is a cross sectional view of another conventional protecting case for a troidal core.
Figure 4:
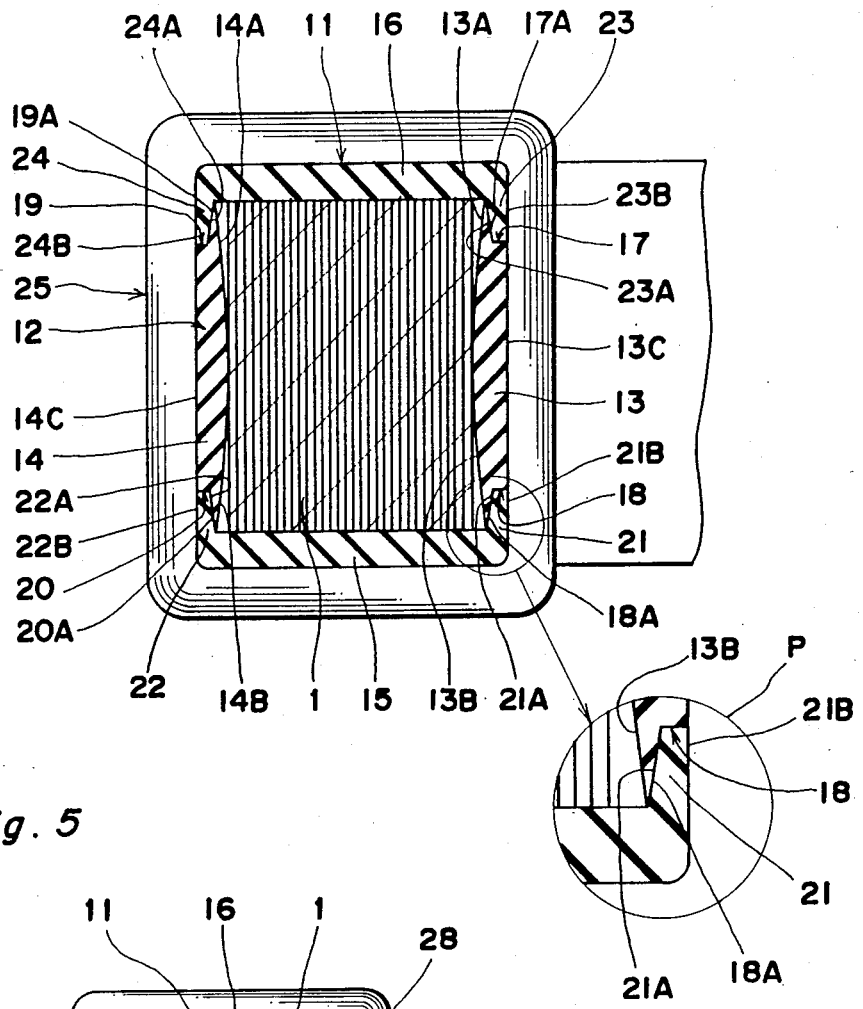
FIG. 4 is a cross sectional view of a protecting case for a magnetic core according to the embodiment of the present invention.

Referring now to FIG. 4, a protecting case 11 for covering the entire surface of a troidal magnetic core 1 is comprised of a case body 12 including an inner and outer cylindrical members 13 and 14 for covering the inner and outer peripheral surfaces of the core 1, a bottom ring member 15 for covering the bottom surface of the core 1 and a cap ring member 16 for covering the top surface of the core 1.

These members 13, 14, 15 and 16 are made of an appropriate insulating material such as wood, synthetic resin, so called press-board or the like.

As is clearly shown in FIG. 4, the inner surface of the inner cylindrical member 13 being opposed to the inner peripheral surface of the core is defined by two tapered surfaces 13A and 13B which are so formed inclined in the axial direction of the core as to have a peak at the intermediate portion where they meet with each other. On the other surface 13C other than the tapered surface of the inner cylindrical member 13, there provided notched shoulders 17 and 18 at each of the upper and lower edge portions. Each longitudinal surface 17A or 18A of the notched shoulders 17 and 18 is formed as a tapered surface having an inclination opposite to that of the tapered surface 13A or 13B, as is clearly shown in a circle P which shows an enlarged view of a portion encircled in FIG. 4.

The inner surface of the outer cylindrical member 14 being opposed to the outer peripheral surface of the core is defined by two tapered surfaces 14A and 14B, similarly to the inner cylindrical member 13, which are so formed inclined in the axial direction of the core as to have a peak at the intermediate portion where they meet with each other. Also, on the other surface 14C other than the tapered surface of the outer cylindrical member 14, there provided notched shoulders 19 and 20 at each of the upper and lower edge portions. Each longitudinal surface 19A or 20A of the notched shoulders 19 and 20 is formed as a tapered surface having an inclination opposite to that of the tapered surface 14A or 14B.

The bottom and cap ring members 15 and 16 provide respectively an inner and outer ribs 21, 22 and 23, 24 along each inner and outer peripheries thereof which are so projected in the axial direction as to fit into the shoulders 17, 19, 18 and 20 respectively.

Each longitudinal surface 21A and 22A of the inner and outer ribs 21 and 22 is tapered so as to fit to the tapered surface of the corresponding shoulder. Also, each longitudinal surface 23A and 24A of the inner and outer ribs 23 and 24 is tapered so as to fit to the tapered surface of the corresponding shoulder.

Further, each outside surface 21B and 23B of both of the inner ribs 21 and 23 is so formed as to be included in a plane defined by the surface 13C of the inner cylindrical member 13. Each outside surface 22B and 24B of the outer ribs 22 and 24 is so formed as to have a plane included in a plane defined by the surface 14C of the outer cylindrical member 14.

Therefore, the protecting case 11, when constructed, has no projected or recessed portion on all of the outer faces thereof.

In order to house the magnetic core 1 in the protecting case 11, at first, the inner cylindrical member 13 is mounted on the bottom ring member 15 by making the lower notched shoulder 18 fit to the inner rib 21 of the bottom ring member 15.

Next, the core 1 is put on the bottom ring member 15 coaxially with the guide of the tapered inner surface 13A of the inner cylindrical member 13. Then, the outer cylindrical member 14 is mounted on the bottom ring member 15, with the guide of the tapered surface 14B of the outer cylindrical member 14 by making the lower notched shoulder 20 fit to the outer rib 22 of the bottom ring member 15.

Finally, the cap ring member 16 is mounted to close the upper aperture defined between the inner and outer cylindrical members 13 and 14 by making the inner and outer ribs 23 and 24 fit to the notched shoulders 17 and 19 respectively.

Thereafter, a winding 25 is wound around the trunk of the protecting case 11 thus formed.

According to the core case of the present invention, there is no need to form a relatively large space between the inner and outer cylindrical members so as to put a magnetic core thereinto loosely and, therefore, it becomes possible to hold the core therebetween without any gap, since the tapered surfaces of the inner cylindrical member serve to guide the fitting of the magnetic core thereto and the tapered surfaces of the outer cylindrical member serve to guide the fitting thereof to the magnetic core. Therefore, it becomes possible to avoid lowering in magnetic properties of the magnetic core which may be caused due to possible displacements upon, for instance mounting the core case into a housing of a transformer.

Further, since the protecting case 11 has a smooth outer surface without any projection or recession, there becomes no gap between the protecting case and the magnetic core. Accordingly, when the present invention is applied to a transformer, the transformer can be minimized to ensure a minimum amount of conducting material for forming a winding.

Figure 5:
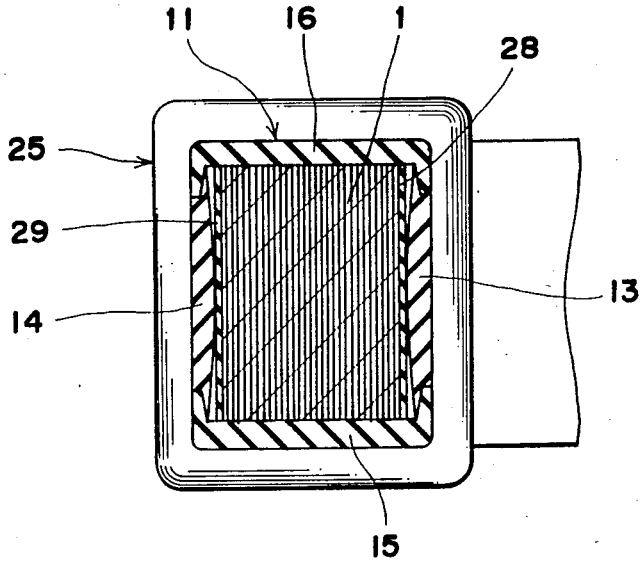
FIG. 5 is a cross sectional view of a protecting case for a magnetic core according to the variation of the present invention.

FIG. 5 shows a variation of the preferred embodiment as shown in FIG. 4.

In this variation, there are provided an inner and outer cylindrical shock absorbers 28 and 29 between the magnetic core 1 and the protecting case 11 which are respectively made of a resilient material such as rubber.

These shock absorbers 28 and 29 are desirable especially for the case in that the magnetic core to be housed is a troidally coiled core of a strip material of an amorphous alloy which is very sensitive to mechanical distortions thereof.

It is to be appreciated that various modifications may be implemented with respect to the above described preferred embodiment. The magnetic core is not limited to a troidal core formed as a coil of a strip material of an amorphous alloy metal and the magnetic core may have a substantially enclosed loop such as a rectangular or oval configuration instead of a circle. Also, the material of the magnetic core may be a steel having a high permeability not limited to an amorphous alloy.

Having thus described the invention in rather full detail, it will be understood that these details need not be strictly adhered to, but that various changes or modifications may suggest themselves to those skilled in the art, all falling within the scope of the invention as defined by the claims.

What is claimed is:

1. A case for protecting a magnetic core, said case having a substantially enclosed shape, said case comprising;

a case body comprising inner and outer members which are adapted to cover the inner and outer peripheral surfaces of the magnetic core respectively, a bottom member being adapted to cover the bottom surface of the magnetic core which has a substantially "U" shaped cross section and a cap member being adapted to cover the top surface of the magnetic core which has a substantially reversed "U" shaped cross section, each of said bottom and cap members defining inner and outer rib portions along the inner and outer peripheries thereof, a taper surface formed on each of the surfaces of the inner and outer members opposing to the inner and outer surfaces of the magnetic core respectively, said taper surface extending between said cap member and bottom member, said taper surface being so inclined as to contact the opposed surface of the magnetic core at the middle portion thereof when seen in the axial direction of the core, a fitting surface formed circumferentially on each of upper and lower end portions of the inner and the outer members, said fitting surface being adapted to fit to a taper surface in the axial direction which is formed on each peripheral side surface of each of the rib portions of the bottom and cap members, and an external surface of the rib portions of the bottom and cap members having a smooth surface as to be in a plane defined by each external surface of the inner and outer members.

2. A case for protecting a magnetic core according to claim 1, wherein said taper surface is comprised of two tapered surfaces which are so formed inclined in the axial direction of the core as to have a peak at the intermediate portion where they meet with each other.

3. A case for protecting a magnetic core according to claim 1, wherein said fitting surface of said upper and lower end portions of the inner and outer members includes a longitudinal taper surface and a notched shoulder, said notched shoulder extending from said longitudinal taper surface to the external surface of said inner and outer members and being adapted to fit to a corresponding shoulder portion on said rib portions.

* * * * *